US008201277B2

(12) United States Patent
Olivarez

(10) Patent No.: US 8,201,277 B2
(45) Date of Patent: Jun. 19, 2012

(54) POSTURE AID FOR CONTACT SPORTS

(75) Inventor: Mike Olivarez, Pflugerville, TX (US)

(73) Assignee: Mike Olivarez, Pflugerville, TX (US)

( * ) Notice: Subject to any disclaimer, the term of this patent is extended or adjusted under 35 U.S.C. 154(b) by 270 days.

(21) Appl. No.: 12/541,514

(22) Filed: Aug. 14, 2009

(65) Prior Publication Data

US 2011/0035865 A1 Feb. 17, 2011

(51) Int. Cl.
*A63B 71/10* (2006.01)

(52) U.S. Cl. ..... 2/425; 2/421

(58) Field of Classification Search ..... 2/6.2, 421, 2/422, 425

See application file for complete search history.

(56) References Cited

U.S. PATENT DOCUMENTS

| | | | | |
|---|---|---|---|---|
| 3,134,106 | A | 5/1964 | Shaffer et al. | |
| 3,671,974 | A | 6/1972 | Sims | |
| 3,818,509 | A | 6/1974 | Romo et al. | |
| 3,900,896 | A | 8/1975 | Ackerman | |
| 5,123,408 | A | 6/1992 | Gaines | |
| 5,272,770 | A | 12/1993 | Allen et al. | |
| 5,404,590 | A | 4/1995 | Monica | |
| 5,493,736 | A | 2/1996 | Allison | |
| 5,517,699 | A | 5/1996 | Abraham | |
| 6,006,368 | A | 12/1999 | Phillips | |
| 6,363,540 | B1 * | 4/2002 | Myers | 2/421 |
| 6,385,781 | B1 | 5/2002 | Rose et al. | |
| 6,813,782 | B2 * | 11/2004 | Kintzi et al. | 2/421 |
| 6,939,269 | B2 * | 9/2005 | Makofsky | 482/10 |
| 6,971,123 | B2 | 12/2005 | Weaver | |
| 7,430,767 | B2 | 10/2008 | Nagely | |
| 2004/0058780 | A1 * | 3/2004 | Edgeton | 482/10 |
| 2007/0083987 | A1 | 4/2007 | Mothaffar | |
| 2007/0245464 | A1 | 10/2007 | Baker | |
| 2008/0256684 | A1 | 10/2008 | Ashline | |
| 2008/0313791 | A1 | 12/2008 | Nagely | |

* cited by examiner

*Primary Examiner* — Shaun R Hurley
*Assistant Examiner* — Andrew Sutton
(74) *Attorney, Agent, or Firm* — Yudell Isidore Ng Russell PLLC

(57) ABSTRACT

In one embodiment, a posture aid apparatus includes a protective helmet having a shell including a face opening and a crown, a strap bracket coupled to the shell intermediate the face opening and the crown, and at least one strap coupled to the strap bracket. The at least one strap has a first connector adapted to be coupled to a first shoulder pad of a pair of shoulder pads and a second connector adapted to be coupled to a second shoulder pad of the pair of shoulder pads, such that proper posture for contact is promoted.

17 Claims, 4 Drawing Sheets

POSTURE AID FOR CONTACT SPORTS

BACKGROUND OF THE INVENTION

1. Technical Field

The present invention relates in general to a posture aid for use with a protective helmet, such as a football helmet, that promotes proper posture for contact during a sport activity.

2. Description of the Related Art

Some contact sports, and in particular the sport of American football, require that participants wear protective helmets in order to protect the participants' heads from injuries. Currently, football helmets used in American football have a rigid polycarbonate alloy outer shell, a cushioning liner within the shell, a faceguard, and a chin strap to secure the helmet to the participant's head.

While football helmets protect participants from certain types of head injuries, the very protection provided by the rigidity of the football helmet and the cushioning provided by the liner can lead both offensive and defensive players to consciously or subconsciously initiate contact with an opposing player using their helmets. Injury resulting from such contact, while statistically infrequent, can be severe and result in spinal injury or paralysis. Consequently, coaches following best practices train their players to overcome the natural reflex to drop their heads prior to impact and to make contact in a proper "heads up" posture.

In addition to verbal instruction and contact drills, specially designed motion-restricting training devices can be used in practice situations to restrain players from assuming head and neck positions that are more likely to result in injury. Such motion restricting devices typically employ one or more rigid motion-restricting struts or brackets that rigidly or semi-rigidly link the back or bottom of the helmet to the player's shoulder pads. Known motion restricting training devices generally require expensive, specially designed helmets and/or shoulder pads and can be time consuming to install and remove. Such specially designed motion-restricting training devices generally do not meet the equipment regulations for protective equipment promulgated by the sport's governing bodies. The expense and difficulty generally associated with using conventional motion-restricting training devices also discourage their use, leaving players vulnerable to injury.

SUMMARY

In some embodiments, a posture aid apparatus includes a protective helmet having a shell including a face opening and a crown, a strap bracket coupled to the shell intermediate the face opening and the crown, and at least one strap coupled to the strap bracket. The at least one strap has a first connector adapted to be coupled to a first shoulder pad of a pair of shoulder pads and a second connector adapted to be coupled to a second shoulder pad of the pair of shoulder pads, such that proper posture for contact is promoted.

DETAILED DESCRIPTION OF ILLUSTRATIVE EMBODIMENT

Figure 1:
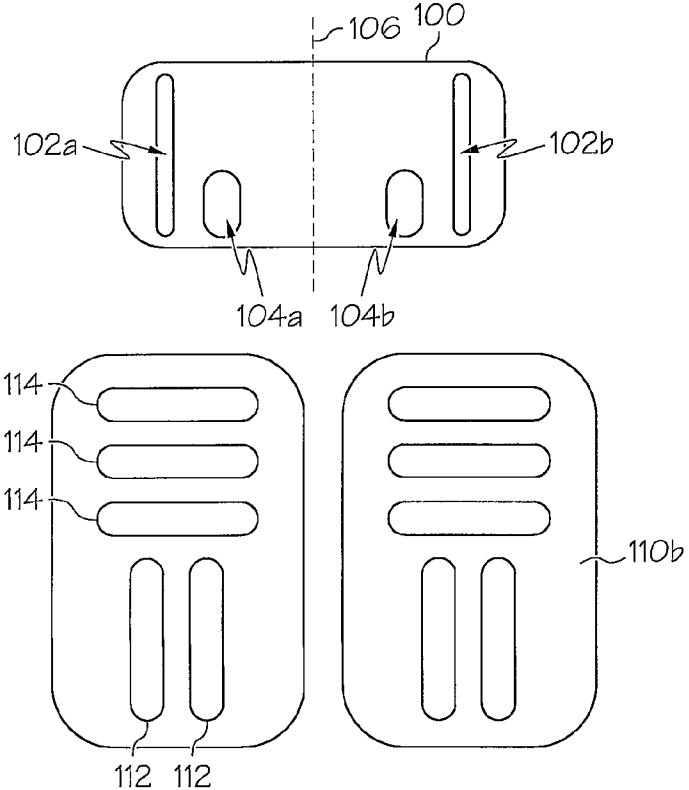
FIG. 1 illustrates embodiments of a strap bracket and two connectors of a posture aid apparatus in accordance with one embodiment.

With reference now to FIG. 1, there are illustrated exemplary embodiments of components of a posture aid apparatus for promoting proper posture for contact in a sport activity, such as American football. As shown in FIG. 1, the posture aid apparatus includes a strap bracket 100 configured to be coupled by at least one helmet strap 400 (see FIG. 4) to a protective helmet 200 (see FIG. 2), such as a football helmet. Strap bracket 100 is preferably formed, for example, of a plastic-coated metal (e.g., steel, stainless steel or titanium), but can alternatively be formed of uncoated metal or a high strength plastic, such as high density polyethylene (HDPE) or fiber-reinforced vinyl.

Figure 2:
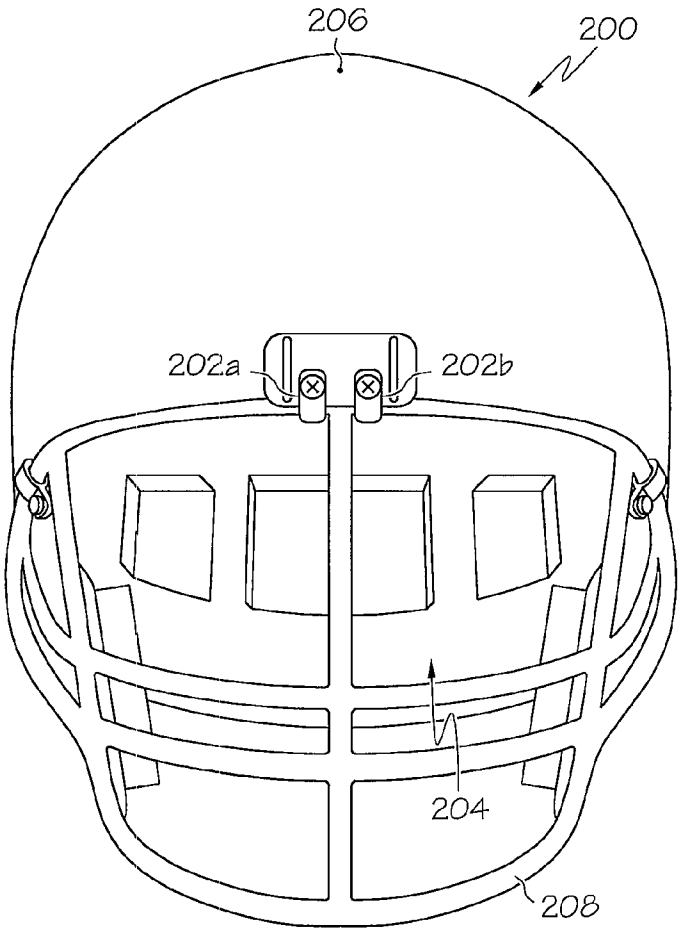
FIG. 2 depicts a protective helmet having a strap bracket attached thereto in accordance with one embodiment.

Although various embodiments of strap bracket 100 can have a variety of shapes and/or sizes, in the illustrated embodiment strap bracket 100 is planar member of substantially rectangular form with a pair of strap slots 102*a*, 102*b* and a pair of mounting holes 104*a*, 104*b* formed there through. As shown in FIG. 2, mounting holes 104*a*, 104*b*, which can be symmetrically displaced from a centerline 106 of strap bracket 100, are preferably spaced to correspond to the locations of the mounting holes in protective helmet 200 (e.g., a football helmet) for central faceguard mounts, such as faceguard attachment loops 202*a*, 202*b*. In this manner, strap bracket 100 can be conveniently removably coupled to protective helmet 100 between face opening 204 and crown 206 using the same fasteners (e.g., screws or bolts) that secure central faceguard attachment loops 202*a*, 202*b* (and hence faceguard 208) to protective helmet 200. As will be appreciated, in at least some embodiments, strap bracket 100 alternatively can be coupled to protective helmet 200 by being integrally formed with protective helmet 200 or by being permanently coupled to protective helmet 200, for example, by adhesion.

In at least some of such alternative embodiments, mounting holese 104*a*, 104*b* can be omitted.

Strap slots 102*a*, 102*b* of strap bracket 100 are preferably sized to receive there through at least one (and preferably a single) helmet strap 400, such as a standard 1.0 or 1.5 inch woven webbing or elastic strap. As with mounting holes 104*a*, 104*b*, strap slots 102*a*, 102*b* can be symmetrically displaced from a centerline 106 of strap bracket 100.

Still referring to FIG. 1, the posture aid apparatus further includes a first connector 110*a* configured to couple a helmet strap 400 (e.g., of woven webbing or elastic) to a first shoulder pad of a pair of shoulder pads and a second connector 110*b* configured to couple a helmet strap 400 to a second shoulder pad of the pair of shoulder pads. As with strap bracket 100, first and second connectors 110*a*, 110*b* are preferably formed of metal (which may optionally be plastic-coated), but can alternatively be formed of a high strength plastic, such as high density polyethylene (HDPE) or fiber-reinforced vinyl.

In the illustrated embodiment, each of first and second connectors 110*a*, 110*b* comprises a planar member configured as a T-slide having a first set of strap-receiving slots 112 and an orthogonal second set of strap-receiving slots 114. Strap-receiving slots 112 are sized to receive there through a conventional underarm elastic or webbing shoulder pad strap used to secure a participant's shoulder pads.

Figure 3:
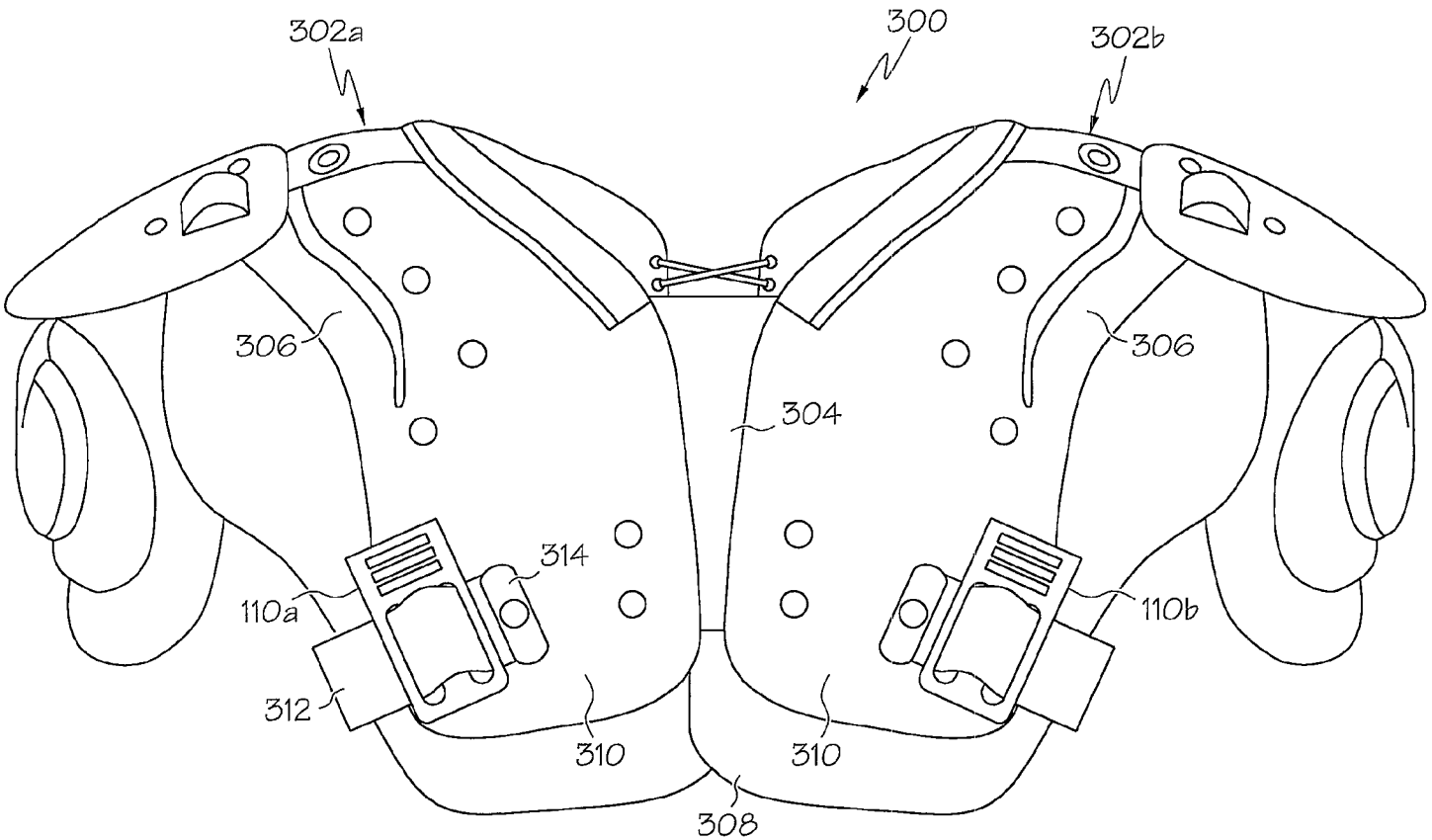
FIG. 3 illustrates a pair of shoulder pads having connectors coupled thereto in accordance with one embodiment.

FIG. 3 illustrates the back of a conventional pair of shoulder pads 300, which form a part of the protective padding worn, for example, by a participant in American football. Shoulder pads 300 include a left shoulder pad 302*a* and a right shoulder pad 302*b*, which are joined in back by a flexible hinge 304. Each shoulder pad 302*a*, 302*b* has an outer plastic yoke 306 formed of durable plastic and an energy absorbing liner 308 formed of foam and/or other cushioning material.

Generally, each of shoulder pads 302*a*, 302*b* is secured to a participant by one or more underarm elastic or webbing shoulder pad straps 312 that are either removably or fixedly attached to a scapular portion 310 of yoke 306 by a fastener, for example, a swiveling riveted slide 314. The other end of each shoulder pad strap 312 typically has removably attached thereto a T-hook, J-hook, swiveling riveted slide, or other fastener to attach that other end of the shoulder pad strap 312 to the pectoral portion 314 (see FIG. 4) of the yoke 306.

To install one of first and second connectors 110*a*, 110*b*, a fastener is removed from one end of shoulder pad strap 312 and this free end of shoulder pad strap 312 is then threaded through strap-receiving slots 112 as shown in FIG. 3. The connector 110*a* or 110*b* is then slid along shoulder pad strap 312 toward its scapular attachment point. The removed fastener is then reinstalled on the free end of the shoulder pad strap 312. When first and second connectors 110*a*, 100*b* are attached in this manner, the strap-receiving slots 114 of each of first and second connectors 110*a*, 110*b* are available to receive and retain therein a helmet strap 400 coupled to strap bracket 100, as described further below with reference to FIG. 4.

Although the exemplary embodiments of first and second connectors 110*a*, 110*b* depicted in FIG. 1 are identical, each of first and second connectors 110*a*, 110*b* can independently vary in form and construction, so long as it remains suitable to couple, to a respective shoulder pad, a helmet strap 400 linking the shoulder pad to the strap bracket 100. For example, in alternative embodiments, the strap-receiving slots 112 of one or both of first and second connectors 110*a*, 110*b* may be replaced by a T-hook or J-hook configured to secure the helmet strap 400 directly to the scapular portion 310 of a yoke 306 rather than to underarm shoulder pad strap 312.

Figure 4:
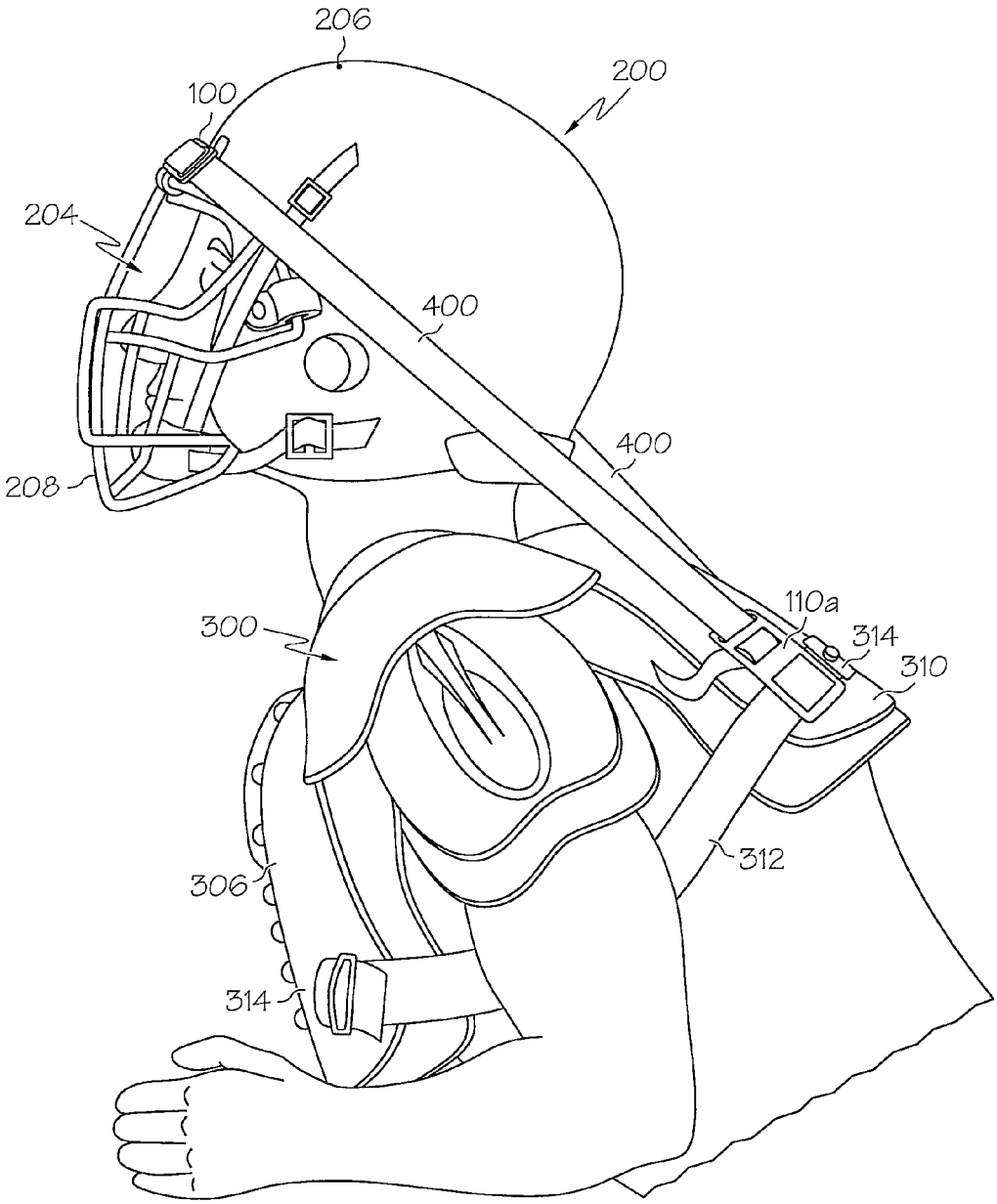
FIG. 4 depicts the installation of a posture aid apparatus in which a strap bracket is coupled by at least one strap to the scapular portions of a pair of shoulder pads to promote proper posture for contact in a sport activity.

Referring now to FIG. 4, there is depicted a posture aid for promoting proper posture for contact in a sport activity as fully installed and worn by a participant in the sport activity. FIG. 4 illustrates a participant in a sport activity, such as American football, wearing a protective helmet 200 and a pair of shoulder pads 300. As described above with reference to FIGS. 2-3, strap bracket 100 is coupled to protective helmet 200 between its face opening 204 and crown 206, and connectors 110*a*, 110*b* are coupled to the respective scapular portions 310 of shoulder pads 302*a*, 302*b* (in this case by attachment to shoulder pad straps 312).

At least one (and preferably, a single) helmet strap 400 further couples strap bracket 100 to connectors 110*a*, 110*b*. Specifically, in FIG. 4 each of the ends of helmet strap 400 is threaded through the strap-receiving slots 114 of a respective one of first and second connectors 110*a* and 110*b* such that helmet strap 400 is frictionally retained in substantially fixed relation thereto. Helmet strap 400 is also threaded through and retained within strap slots 102*a* and 102*b* of strap bracket 100. The effective length of helmet strap 400 between first and second connectors 110*a* and 110*b* can be adjusted (e.g., by a coach or trainer of the participant) as needed so that the participant adopts the proper "heads up" posture for contact shown in FIG. 4 and is restrained from dropping his head into a more injury-prone position as the prospect of contact arises. By training in this posture, for example, during drills or practice sessions, the participant will over time develop "muscle memory" and begin to instinctively adopt the desired posture for contact.

It should be appreciated that the posture aid disclosed herein can be rapidly installed and uninstalled on the protective equipment of one or more participants in a sport activity, for example, in preparation for contact drills during practice. It should also be appreciated that strap bracket 100 and first and second connectors 110 can also remain installed in place on the protective equipment even when helmet strap 400 is not worn without interfering in the conduct of an official game of a sport activity (e.g., American football) and without requiring a rule change regarding the protective equipment that may be worn by participants in an official game.

Figure 5:
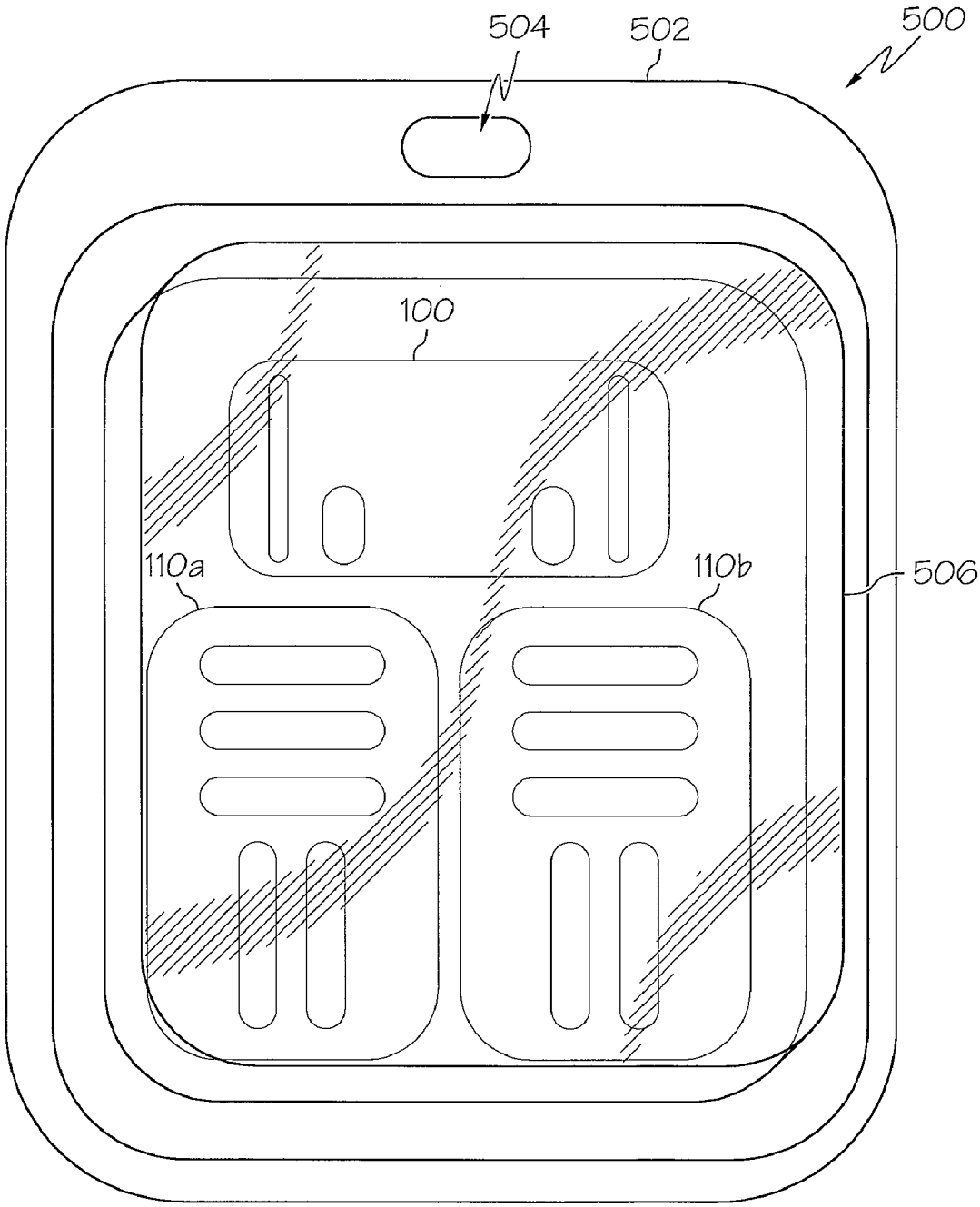
FIG. 5 illustrates an exemplary embodiment of a posture aid kit in which a strap bracket and two connectors are packaged together.

With reference now to FIG. 5, a posture aid kit in accordance with one embodiment is illustrated. In the illustrated embodiment, the posture aid kit comprises a package 500 containing at least a strap bracket 100 and first and second connectors 110*a*, 110*b* as described above. In some embodiments, the posture aid kit may further include a helmet strap 400, such as a woven webbing or elastic strap.

As shown, package 500 can be realized as a paperboard card 502 to which is sealed a semi-rigid plastic window 506 containing the components of the posture aid kit. Alternatively, package 500 can be realized as a clamshell package, a blister pack or other known or future developed type of package. Package 500 can farther conveniently include a through hole 504 to permit vertical display of package 500 on a post or rack.

As has been described, in at least one embodiment, a posture aid apparatus includes a protective helmet having a shell including a face opening and a crown, a strap bracket coupled to the shell intermediate the face opening and the crown, and at least one strap coupled to the strap bracket. The strap has a first connector adapted to be coupled to a first shoulder pad of a pair of shoulder pads and a second connector adapted to be coupled to a second shoulder pad of the pair of shoulder pads, such that proper posture for contact is promoted.

In at least one embodiment, a posture aid kit for promoting proper posture for contact during a sport activity includes a strap bracket configured to be coupled to a shell of a protective helmet intermediate a face opening and a crown of the protective helmet. The strap bracket including at least one through hole for receiving a strap there through. The posture aid kit also includes first and second connectors each configured to be coupled both to the strap and to a scapular portion of a respective one of a pair of shoulder pads, such that proper posture for contact is promoted.

While the present invention has been particularly shown as described with reference to one or more preferred embodiments, it will be understood by those skilled in the art that various changes in form and detail may be made therein without departing from the spirit and scope of the invention.

What is claimed is:

1. An apparatus, comprising:

a protective helmet having a shell including a front portion having a face opening, a closed back portion, a crown, and a faceguard having a faceguard mount;

a strap bracket coupled to the front portion of the shell intermediate the face opening and the crown, wherein the faceguard mount and the strap bracket are collocated, and wherein the strap bracket has at least one screw hole formed therein by which a screw can secure the strap bracket and the faceguard mount to the protective helmet; and at least one strap coupled to the strap bracket and having a first connector adapted to be coupled to a first shoulder pad of a pair of shoulder pads and a second connector adapted to be coupled to a second shoulder pad of the pair of shoulder pads, such that proper posture for contact during a sport activity is promoted.

2. The apparatus of claim 1, wherein the at least one strap comprises flexible webbing.

3. The apparatus of claim 1, wherein the strap bracket is formed of coated metal.

4. The apparatus of claim 1, wherein:

the strap bracket has at least one slot; and the at least one strap passes through the at least one slot of the strap bracket.

5. The apparatus of claim 1, wherein the at least one strap is a single strap.

6. The apparatus of claim 1, wherein the first and second connectors comprise slides.

7. The apparatus of claim 1, and further comprising the pair of shoulder pads, wherein each of the first and second shoulder pads includes an arched shell having a scapular portion, and wherein the first connector is adapted to be coupled to the scapular portion of the first shoulder pad and the second connector is adapted to be coupled to the scapular portion of the second shoulder pad.

8. An apparatus comprising:

a protective helmet having a shell including a front portion having a face opening, a closed back portion, a crown;

a strap bracket coupled to the front portion of the shell intermediate the face opening and the crown;

a pair of shoulder pads including a first shoulder pad and a second shoulder pad, wherein each of the first and second shoulder pads includes an arched shell having a scapular portion; and at least one strap coupled to the strap bracket and having a first connector adapted to be coupled to the scapular portion of the first shoulder pad and a second connector adapted to be coupled to the scapular portion of the second shoulder pad, such that proper posture for contact during a sport activity is promoted.

9. The apparatus of claim 8, wherein the at least one strap comprises flexible webbing.

10. The apparatus of claim 8, wherein the strap bracket is formed of coated metal.

11. The apparatus of claim 8, wherein:

the strap bracket has at least one slot; and the at least one strap passes through the at least one slot of the strap bracket.

12. The apparatus of claim 8, wherein the at least one strap is a single strap.

13. A posture aid kit for promoting proper posture for contact during a sport activity, the posture aid kit comprising:

a strap bracket configured to be coupled to a shell of a protective helmet including a front portion having a face opening, a closed back portion, and a crown, at a location on the front portion intermediate the face opening and the crown, wherein the strap bracket includes at least one through hole for receiving a strap there through, and wherein the strap bracket has at least one screw hole formed therein by which a faceguard screw can secure the strap bracket to the protective helmet; and first and second connectors each configured to be coupled both to the strap and to a scapular portion of a respective one of a pair of shoulder pads, such that proper posture for contact during a sport activity is promoted.

14. The posture aid kit of claim 13, and further comprising the strap.

15. The posture aid kit of claim 13, and further comprising a package containing the strap bracket and the first and second connectors.

16. The posture aid kit of claim 13, wherein the strap bracket is formed of coated metal.

17. The posture aid kit of claim 13, wherein the first and second connectors comprise slides.

* * * * *